United States Patent [19]

Hoebel

[11] Patent Number: 4,911,797

[45] Date of Patent: Mar. 27, 1990

[54] CONTACT ROLLER MOUNTING ASSEMBLY AND TENSIONING MECHANISM FOR ELECTROPLATING FIBER

[75] Inventor: Robert E. Hoebel, Bristol, Conn.

[73] Assignee: American Cyanamid Company, Stamford, Conn.

[21] Appl. No.: 507,612

[22] Filed: Jun. 24, 1983

[51] Int. Cl.[4] ..... C25D 7/06

[52] U.S. Cl. ..... 204/28; 204/130; 204/206

[58] Field of Search ..... 204/28, 130, 206, 211; 198/854; 226/118, 119, 195

[56] References Cited

U.S. PATENT DOCUMENTS

| | | | |
|---|---|---|---|
| 2,776,939 | 1/1957 | Newton | 204/28 |
| 2,828,250 | 3/1958 | Hurd | 204/28 |
| 3,246,818 | 4/1966 | Davis | 226/90 |
| 3,316,160 | 4/1967 | Uchida et al. | 204/28 |
| 3,622,283 | 11/1971 | Sara | 29/183.5 |
| 3,643,844 | 2/1972 | Hunter | 226/111 |
| 3,807,996 | 4/1974 | Sara | 75/204 |
| 3,894,677 | 7/1975 | La Iacona | 228/190 |
| 4,007,866 | 2/1977 | Traise | 226/31 |
| 4,132,828 | 1/1979 | Nakamura et al. | 428/366 |
| 4,186,893 | 2/1980 | Kolosov et al. | 242/56.9 |
| 4,525,905 | 7/1985 | Bogucki-Land | 28/185 |
| 4,624,751 | 11/1986 | Morin et al. | 204/28 |

FOREIGN PATENT DOCUMENTS

| | | |
|---|---|---|
| 52-43770 | 11/1977 | Japan . |
| 1272777 | 5/1972 | United Kingdom . |

OTHER PUBLICATIONS

V. V. Ponomar et al., "Characteristics of the Deposition of Electrochemical Coatings on Continuous Carbon Fibers", Izv. Akad. Naak Mold. SSR, Ser. Fiz.—Tekh. Mat. Nauk 1975, No. 2, pp. 75–80.

*Primary Examiner*—John F. Niebling
*Assistant Examiner*—William T. Leader
*Attorney, Agent, or Firm*—Steven H. Flynn

[57] ABSTRACT

An array of rollers arranged to impose tension on a fiber passing through a continuous process and an apparatus for releasably mounting contact rollers.

2 Claims, 9 Drawing Sheets

CONTACT ROLLER MOUNTING ASSEMBLY AND TENSIONING MECHANISM FOR ELECTROPLATING FIBER

CROSS-REFERENCE TO RELATED APPLICATIONS

This application is related to APPARATUS AND PROCESS FOR CONTINUOUSLY PLATING FIBER and to IMPROVED TENSIONING MECHANISM AND CATHODE ROLLERS FOR FIBER PLATING by LOUIS G. MORIN and ROBERT F. HOEBEL both of which are being filed coincidentally with this application.

BACKGROUND OF THE INVENTION

1. Field of the Invention

This invention relates to metal coated filaments and to a process and an apparatus for their continuous production.

2. Description of the Prior Art.

Filaments comprising non-metals and semi-metals, such as carbon, boron, silicon carbide, polyester, nylon, aramid, cotton, rayon, and the like, in the form of monofilaments, yarns, tows, mats, cloths and chopped strands are known to be useful in reinforcing metals and organic polymeric materials. Articles comprising metals or plastics reinforced with such fibers find wide-spread use in replacing heavier components made up of lower strength conventional materials such as aluminum, steel, titanium, vinyl polymers, nylons, polyester, etc., in aircraft, automobiles, office equipment, sporting goods, and in many other fields.

A common problem in the use of such filaments, and also glass, asbestos and others, is a seeming lack of ability to translate the properties of the high strength filaments to the material to which ultimate and intimate contact is to be made. .In essence, even though a high strength filament is employed, the filaments are merely mechanically entrapped, and the resulting composite pulls apart or breaks at disappointingly low applied forces.

The problems have been overcome in part by depositing a layer or layers of metals on the individual filaments prior to incorporating them into the bonding material, e.g., metal or plastic. Metal deposition has been accomplished by vacuum deposition, e.g., the nickel on fibers as described in U.S. Pat. No. 4,132,828 and by electroless deposition from chemical baths, e.g, nickel on graphite filaments as described in U.S. Pat. No. 3,894,677; and by electrodeposition, e.g., the nickel electroplating on carbon fibers as described in Sara, U.S. Pat. No. 3,622,283 and in Sara, U.S. Pat. No. 3,807.996. When the metal coated filaments of such procedures are twisted or sharply bent, a very substantial quantity of the metal flakes off or falls off as a powder. When such metal coated filaments are used to reinforce either metals or polymers, the ability to resist compressive stress and tensile stress is much less than what would be expected from the rule of mixtures, and this is strongly suggestive that failure to efficiently reinforce is due to poor bonding between the filament and the metal coating.

It has now been discovered that if electroplating is selected and if an amount of voltage is selected and used in excess of that which is required to merely dissociate (reduce) the electrodepositable metal ion on the filament surface, a superior bond between filament and metal layer is produced. The strength is such that when the metal coated filament is sharply bent, the coating may fracture, but it will not peel away. Moreover, continuous lengths of such metal coated filaments can be knotted and twisted without substantial loss of the metal to flakes or powder. High voltage is believed important to provide or facilitate uniform nucleation of the electrodepositable metal on the filament, and to overcome any screening or inhibiting effect of materials absorbed on the filament surface.

Although a quantity of electricity is required to electrodeposit metal on the filament surface, an increase in voltage to increase the amperes may cause the filaments to burn, which would interrupt a continuous process. The aforesaid Sara Pat. No. 3,807,966, uses a continuous process to nickel plate graphite yarn, but employs a plating current of only 2.5 amperes, and long residence times, e.g. 14 minutes, and therefore low, and conventional,voltages. In another continuous process, described in U.K. Pat. No. 1,272,777, the individual fibers in a bundle of fibers are electroplated without burning them up by passing the bundle through a jet of electrolyte carrying the plating material, the bundle being maintained at a negative potential relative to the electrolyte, in the case of silver on graphite, the potential between the anode and the fibers being a conventional 3 volts.

The present invention provides an efficient apparatus to facilitate increasing the potential between anode and the continuous filament cathode, since it is a key aspect of the present process to increase the voltage to obtain superior metal coated fibers. In addition, since it permits extra electrical energy to be introduced into the system without burning up the filaments, residence time is shortened, and production rates are vastly increased over those provided by the prior art. As will be clear-from the detailed description which follows, novel means are used to provide high voltage plating, strategic cooling, efficient electrolyte-filament contact and high speed filament transport in various combinations, all of which result in enhancing the production rate and quality of metal coated filaments. Such filaments find substantial utility, for example, when incorporated into thermoplastic and thermoset molding compounds for aircraft lightning protection, EMI/RFI shieldinng and other applications requiring electrical/thermal conductivity. They are also useful in high surface electrodes for electrolytic cells. Composites in which such filaments are aligned in a substantially parallel manner dispersed in a matrix of metal, e.g., nickel coated graphite in a lead or zinc matrix are characterized by light weight and superior resistance to compressive and tensile stress. The apparatus of this invention can also be employed to enhance the production rate and product quality when electroplating normally non-conductive continuous filaments, e.g., polyaramids or cotton, etc., if first an adherent electrically conductive inner layer is deposited, e.g., by chemical means on the non-conductive filament.

SUMMARY OF THE INVENTION

It is a basic object of the present invention to provide fibers formed of a conductive semi-metallic core with metallic coatings.

It is another object of the present invention to provide a process in which the electroplating of the fibers is effected under high voltage electroplating conditions.

Further, it is an object of the present invention to provide a process and apparatus which will efficiently and rapidly coat fibers with metallic coatings and facilitate the cleaning and collecting of the finished product.

In accordance with the present invention, apparatus has been provided in which a plurality of fibers can be simultaneously plated efficiently with a metal surface and thereafter cleaned and reeled for use in a variety of end products.

The apparatus is a continuous line provided generally with a pay-out assembly adapted to deliver a multiplicity of fibers to an electrolytic plating bath. The line includes a pre-treatment process, after which the metal-plating is performed in a continuous process by the passage of the clean fibers through an electrolyte under high voltage conditions. Means are provided to cool the fibers during the passage from the contact roll associated with the electrolytic tank and the electrolyte bath.

Further, the fibers pass over contact rollers into the electrolyte. The line includes an assembly of tensioning rollers that serve to insure a tight direct line of the fiber from the contact roller to the electrolyte.

The tensioning rollers are comprised of a plurality of driven rollers over which the fibers pass, and the path of the fibers are reversed to create tension. The tensioning rollers are driven independently of the drive for the processing apparatus and at a speed equal to or less than the speed of the fiber. The speed is determined by visual inspection.

The contact rollers are located in close proximity to the surface of the electrolyte, and by virtue of the processing conditions require frequent change. As a result the contact rollers are mounted on fixed aligned mounts. The mounts both carry support bushings having an outside diameter equal to the inside diameter of the contact roller.

DESCRIPTION OF THE DRAWINGS

The invention will be more readily understood when viewed in association with the following drawings wherein.

DESCRIPTION OF THE PREFERRED EMBODIMENT

The process and apparatus of the present invention are directed to providing an efficient and complete means for metal-plating non-metallic and semi-metallic fibers.

The process of the invention relies on the use of very high voltage and current to effect satisfactory plating. As a result of the high voltage and current, an apparatus has been developed that can produce high volumes of plated material under high voltage conditions.

The process of the present invention and the apparatus particularly suitable for practicing the process of the invention are described in the preferred embodiment in which the specified fiber to be plated is a carbon or graphite fiber and the plating metal is nickel. However, the process and apparatus of the present invention are suitable for virtually the entire spectrum of metal-plating of non-metallic and semi-metallic fibers.

Figure 1:
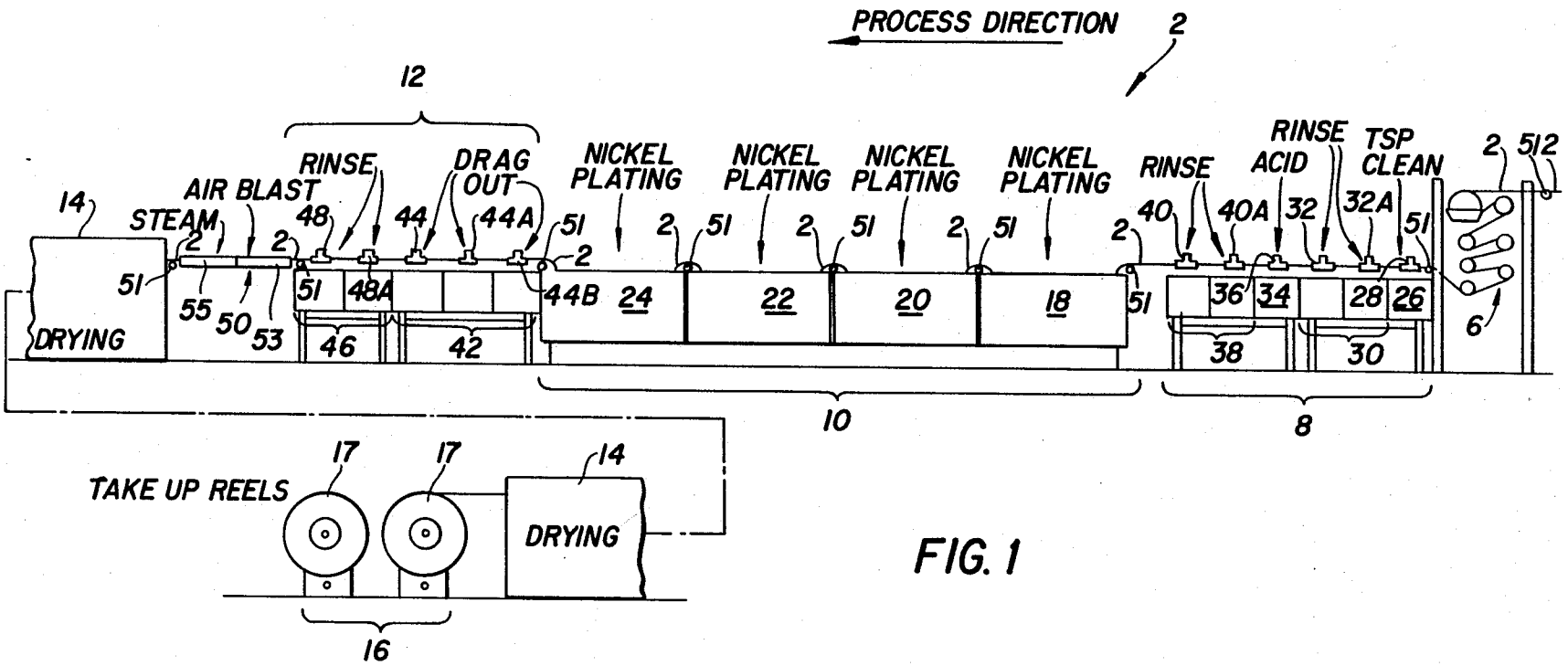
FIG. 1 is a schematic view of the overall process of the subject continuous electrolytic plating process except for the pay-out assembly.

The overall process and schematic of the apparatus except for the pay-out assembly are generally shown in FIG. 1. The operative process includes in essence, a pay-out assembly for dispensing multiple fibers in parallel, tensioning rollers 6, a pre-treatment section 8, a plating facility 10, a rinsing station 12, a drying section 14 and take-up reels 16.

More particularly, the pre-treatment section shown generally in FIG. 1 includes a tri-sodium phosphate cleaning section 26 and an associated washing tee 28, rinse section 30 and associated washing-tees 32 and 32A, a hydrochloric acid section 34 and associated tee 36, and rinse section 38 with associated washing tees 40 and 40A. The plating facility 10 is comprised of series arranged electrolyte tanks of a plurality of series arranged electrolytes tanks shown illustratively in FIG. 1 as tanks 18, 20, 22 and 24, each of which is charged with current by a separate rectifier, better seen in FIGS. 5 and 15. The rinsing section 12, shown generally in FIG. 1 is comprised of tank and tee assemblies similar to the pre-treatment apparatus. An arrangement of cascading tanks 42 and tees 44, 44A and 44B cycle rinse solution of water and electrolyte over the fibers 2. Thereafter, clean water is passed over the fibers 2 in the rinse section 46 provided with tanks and washing-tees 48 and 48A. The rinsed fiber 2 is the passed through section 50 wherein it is first air blasted in chamber 53 and then steam treated in section 55 to produce an oxide surface on the metal plate. The process is completed by passage of the metal plated fiber 2 through the drying unit 14 and reeling of the finished fibers on take-up reels 17 in the reeling section 16.

As seen generally in FIG. 1, the apparatus is provided with means to convey the fibers 2 through the system rapidly without abrading the fibers 2. The combination of strategically located guide rollers 51, tension rollers 6, force imposing rollers in the drying section 14 and a synchronous drive assembly shown in FIG. 16 rapidly conveys the fibers 2 through the apparatus without abrasion of the fibers 2.

Figure 3:
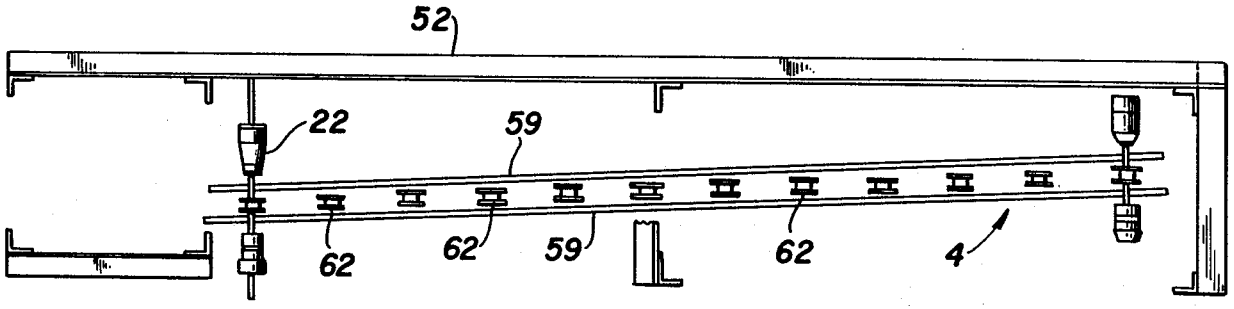
FIG. 3 is a plan view of the pay-out assembly of FIG. 2.
Figure 2:
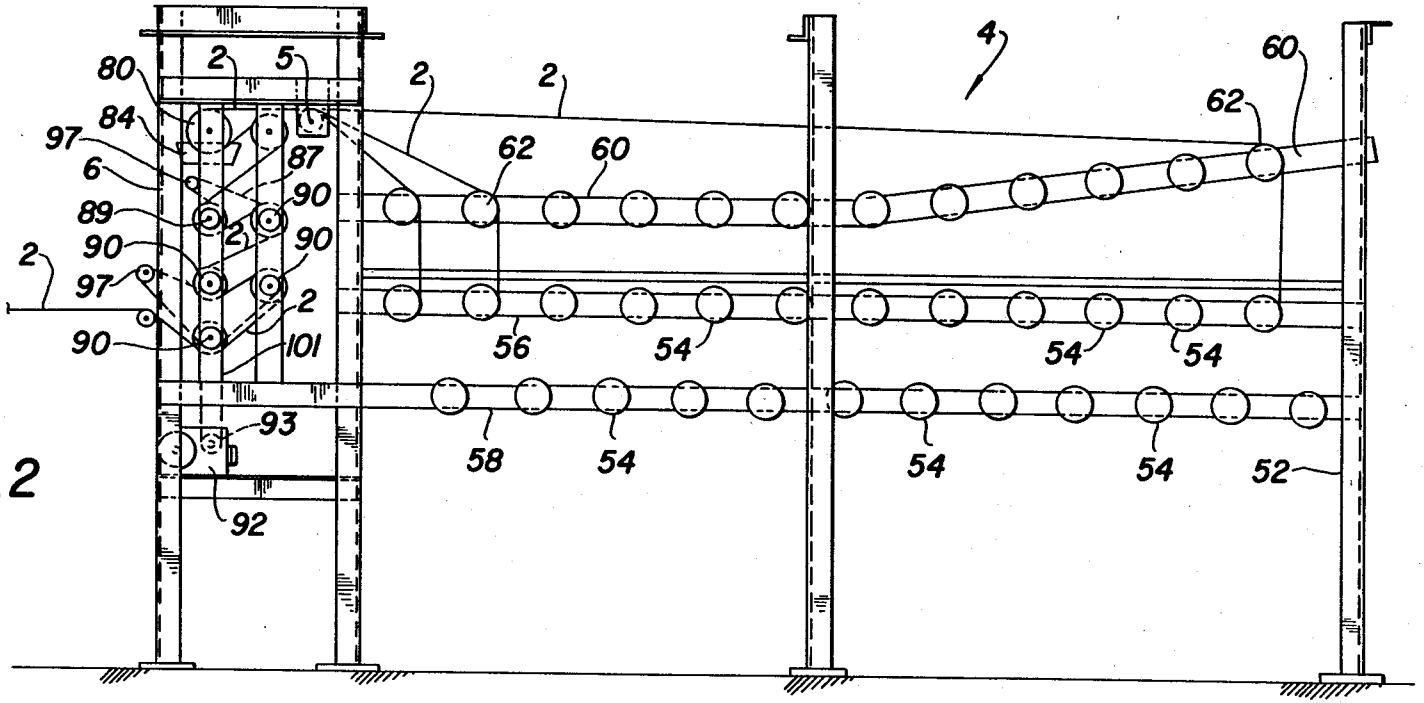
FIG. 2 is an elevational view of the pay-out section arranged specifically to simultaneously deliver a multiplicity of fibers to the electrolytic plating operation.

The operation begins with the pay-out assembly 4 shown in FIGS. 2 and 3. Functionally, the fibers 2 from the pay-out assembly 4 are delivered over a guide roller 5 through the tensioning rollers 6 to the pretreatment section 8.

As best seen in FIGS. 2 and 3, the pay-out assembly 4 is comprised of a frame 52 on which the pay-out rollers 54 are mounted. The pay-out rollers 54 are mounted on the frame 52 on a rail 56 and a rail 58. The rollers 54 on rail 56 are arranged to pay-out the fibers 2 to the electroplating system while the rail 58 is an auxiliary rail adapted to mount the spare rollers 54 available to provide alternate duty. A rail 60 mounts guide rollers 62 over which the fibers 2 from the pay-out rollers 54 travel to reach the tensioning rollers 6. As best seen in FIG. 2, the fibers 2 extend from the respective rollers 54 over individual guide roller 62 associated with a particular roller 54 to the common guide roller 5 and into the tensioning roller assembly 6. Guide bars 59 are provided to guide fibers 2 from the pay-out rollers 54 to the associated guide rollers 62.

As seen in FIG. 3, the guide rollers 62 are aligned adjacent to each other to avoid interference between the fibers 2 as a plurality of fibers 2 are simultaneously delivered to the system to be treated and plated.

Figure 4:
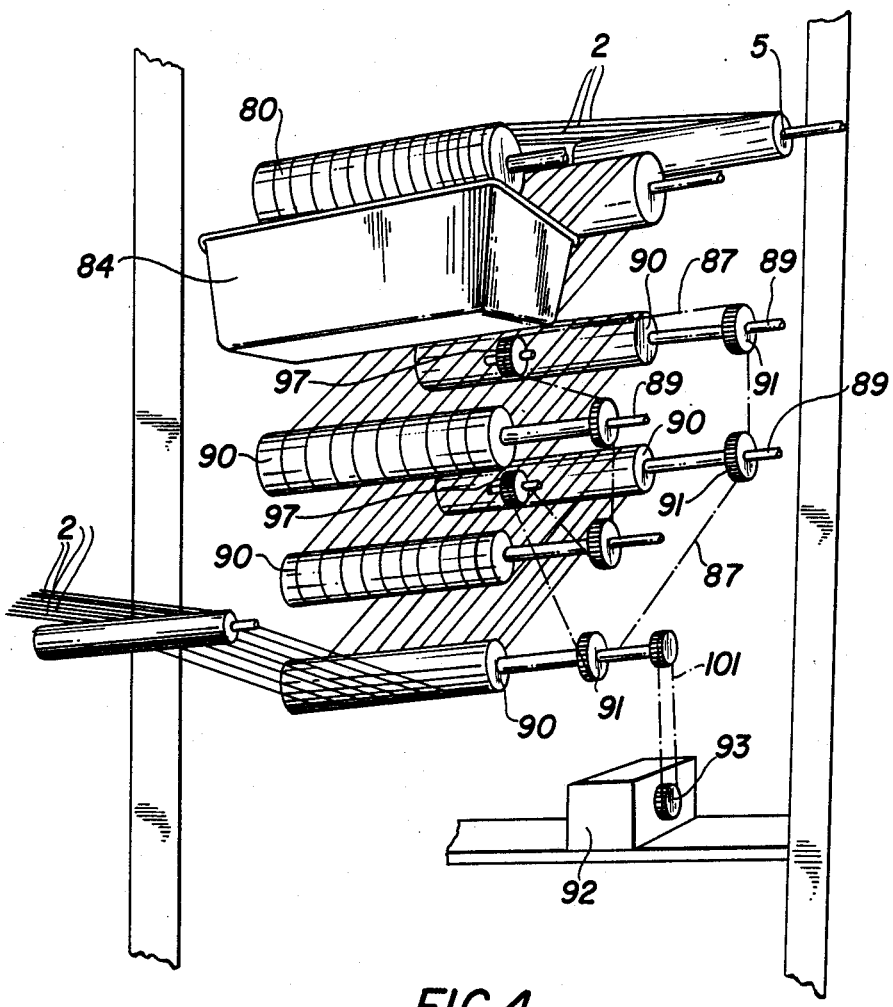
FIG. 4 is an isometric view of the wetting and tensioning rollers between the pay-out and electrolytic bath.

The pay-out assembly 4 delivers the fibers 2 over a guide roller 5 to a wetting roller 80 and then to the tensioning rollers 6. A wetting tub 84 is provided with water which wets the fibers 2 and enables suitable and more efficient cleaning and rinsing of the fibers 2 during pre-treatment. Tee tensioning rollers 6 seen in FIG. 1 are shown in more detail in FIG. 4.

The tensioning rollers 6 comprise an assembly of five rollers 90, all of which are driven through a single continuous chain 87 by a common source such as a variable speed motor 92. Each roller 9 is mounted on a shaft 89 which also mounts a fixed gear 91 around which the chain 87 is arranged. Idler rollers 97 are also arranged to engage the chain 87. A year 93 extending from the shaft 95 of the variable speed motor 92 drives the continuous chain 87 through a chain 101 and a gear 103 fixed to the shaft 89 of a roller 90. It is necessary that tension be provided to the fibers 2 at a location in the line upstream of the first plating contact roller. The plating contact roller and the fibers 2 must be in tight contact to facilitate the operation at the high voltage and high current levels necessary for the process. With tight contact, low resistance is provided between the fibers 2 and the contact rollers, thus the high current passing through the system circuit will not overload the fibers 2 causing destruction of the fibers. As a result, the tension roller assembly 6 is located upstream of the electroplating tanks 18, 20, 22, 24 (FIG. 1) to provide that tension. On the other hand, the fibers should be subjected to as little drag as possible. Inherent in the fibers 2 is the tendency to separate at the surface and accumulate fuzz. The variable drive motor 92 is coupled to all five of the rollers 90 to provide variable speed for the rollers at some speed equal to or less than the speed of the fibers 2. At carefully controlled speeds the necessary tension is provided without causing fuzz to accumulate on the fibers. The apparatus and process are designed to afford a tension roller assembly 6 in which the tension rollers 90 travel at a slower speed than the fibers 2. The tension on the fibers 2 is maintained by varying the speed of the tension roller 90 in response to visual determination of the tension.

The pre-treated fibers 2 are next electroplated. As seen in FIG. 1, a plurality of electroplating tanks 18, 20, 22 and 24 are provided in series. Under the high voltage-high current conditions of the proceds, the series arrangement of electroplating tank 18, 20, 22 and 24 afford means for providing discrete voltage and current to the fibers 2 as a function of the accumulation of metal-plating on the fibers 2. Thus, depending on the amount of metal-plating on the fibers 2, the plating voltage and current can be set to levels most suitable for the particular resistance developed by the fiber and metal.

Figure 5:
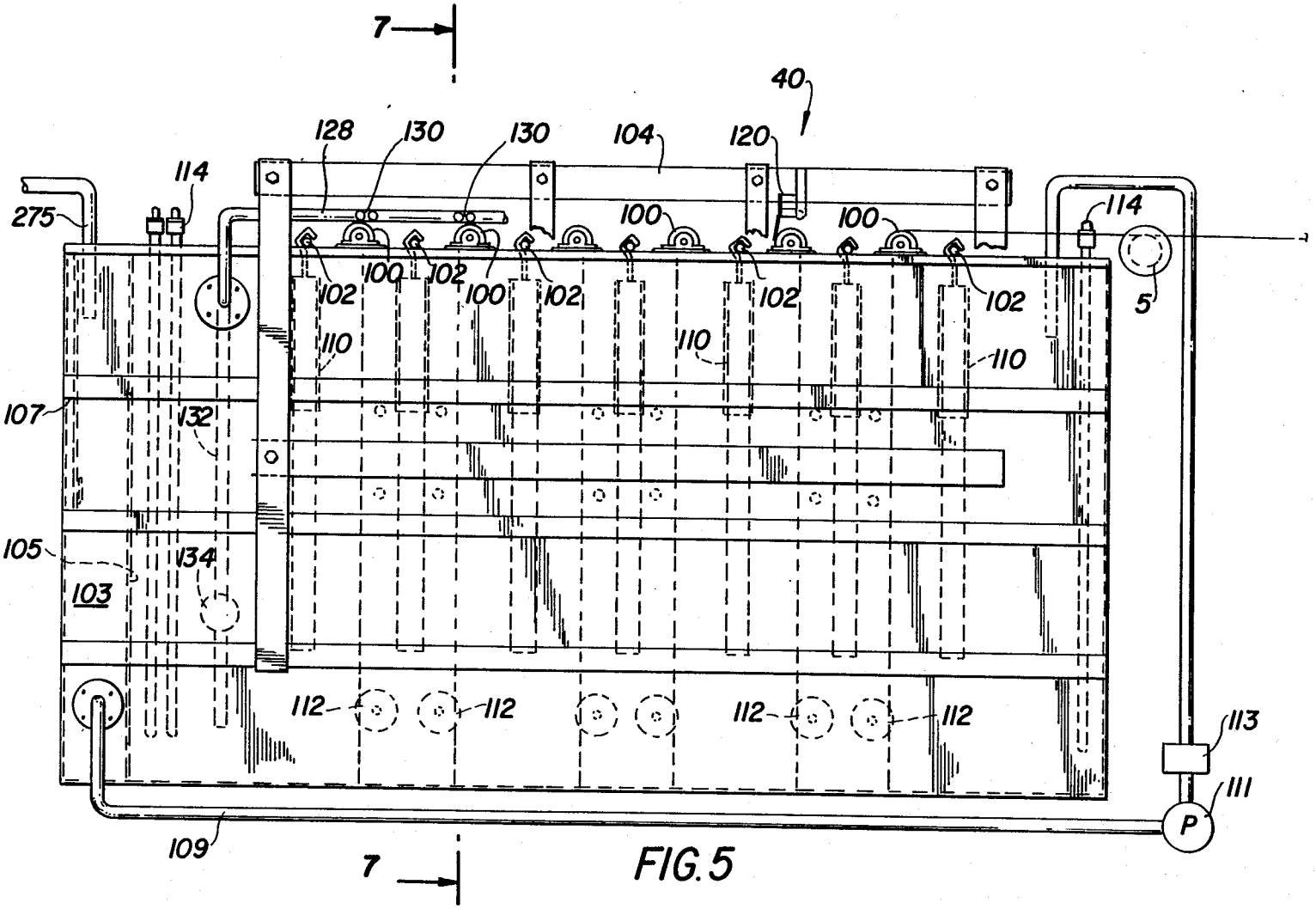
FIG. 5 is an elevational view of one electrolytic tank.
Figure 6:
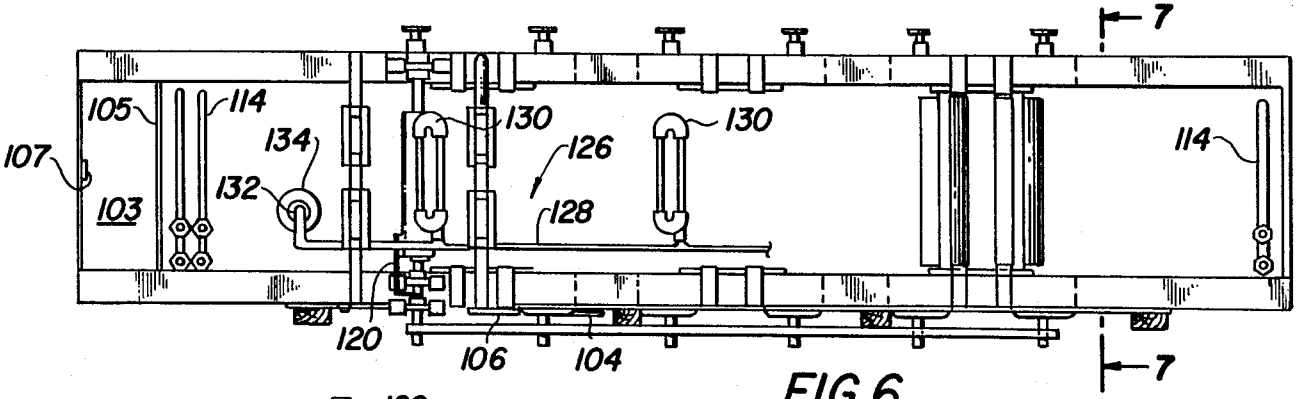
FIG. 6 is a plan view of the tank of FIG. 5.
Figure 7:
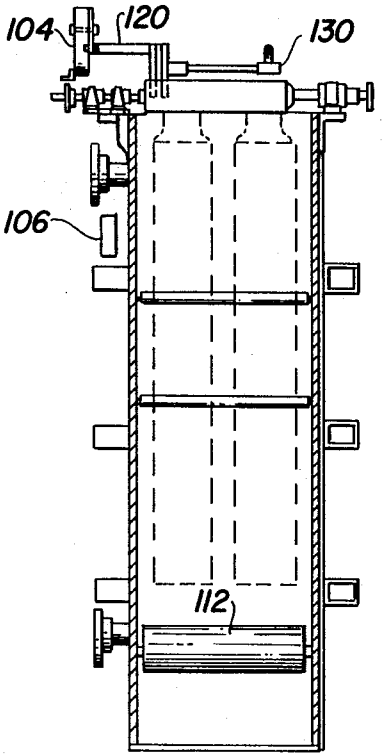
FIG. 7 is a sectional elevational view through line 10—10 of FIG. 5.
Figure 9:
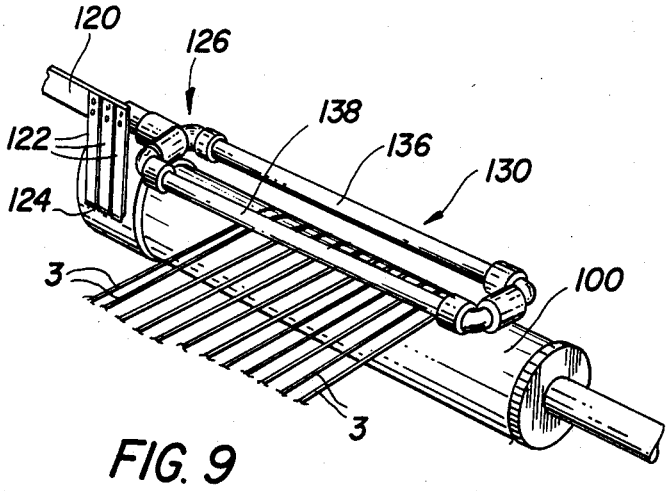
FIG. 9 is an isometric view of one contact roller in association with the means for providing coolant to the fibers and a current carrying medium from the contact roller to the bath.
Figure 15:
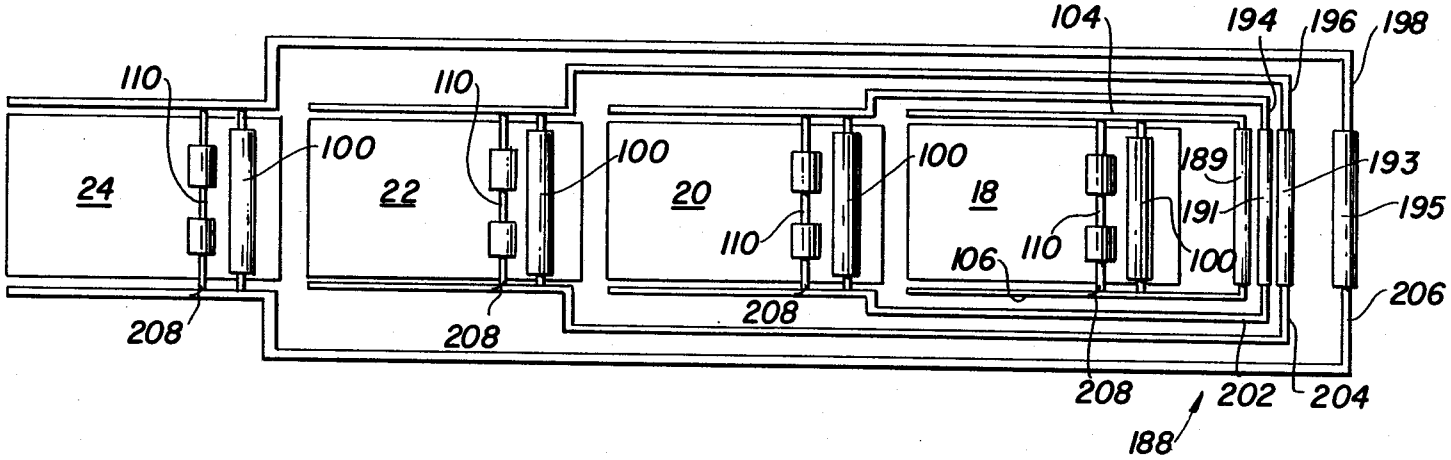
FIG. 15 is a view of the electrical system of the present invention.

The electrolytic plating tank 18 is shown in FIGS. 5, 6 and 7 and is identical in structure to the plating tanks 20, 22 and 24 shown in FIG. 1. The tank 18 is arranged to hold a bath of electrolyte. The tank 18 has mounted therewith contact rollers 100 and anode support bars 102 which are arranged in the circuit. The contact rollers 100 receive current from the bus bar 104 and the anode support bars 102 are connected directly to a bus bar 106. Each of the plating tanks 18, 20, 22 and 24 are provided with similar but separate independent circuitry as seen in FIG. 15. The anode support bars 102 have mounted thereon anode baskets 110 arranged to hold and transfer current to nickel or other metal-plating chips.

Each tank 18, 20, 22 and 24 is also provided with heat exchangers 114 to heat the electrolyte bath to reach the desirable initial temperature at start-up and to cool the electrolyte during the high intensity current operation.

The tank 18 is provided with a well 103 defined by a solid wall 105 in which a level control 107 is mounted and with a recalculation line 109. The recalculation line 109 includes a pump 111 and a filter 113 and functions to continuously recirculate electrolyte from the well 103 to the tank 18. Under normal operating conditions recirculate electrolyte will enter the tank 18 and cause the electrolyte in the tank to rise to a level above the wall 105 and flow into the well 103. When electrolyte has evaporated from the tank the level in the well will drop and call for make-up from the downstream rinse section 12.

The tank 18 is also provided with a line 132 and pump 134 through which electrolyte is pumped to a manifold 128 that delivers the electrolyte to the spray nozzle 130 above the contact rollers 100.

Figure 10:
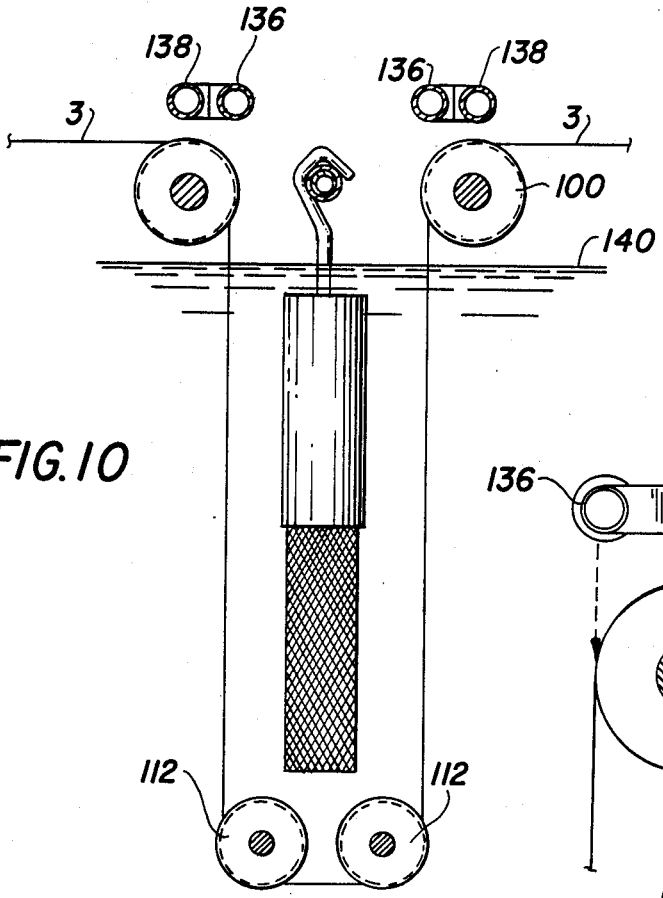
FIG. 10 is an elevational view of a section of the electrolytic tank depicting an anode basket.
Figure 11:
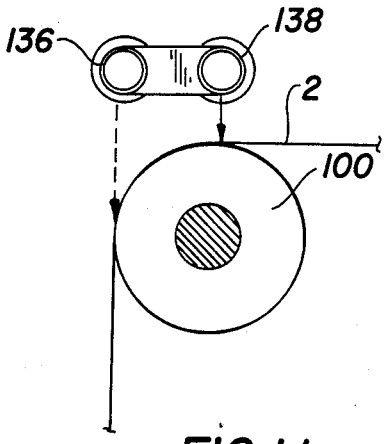
FIG. 11 is a schematic of the electrolytic coolant conductor and a contact roller.

As shown in more detail in FIG. 10, the fibers 2 pass over the contact roller 100 and around idler rollers 112 located in proximity to the bottom of the tank. The idler rollers 112 are provided in pairs around which the fibers 2 pass to move into contact with the succeeding contact roller 100.

Figure 8:
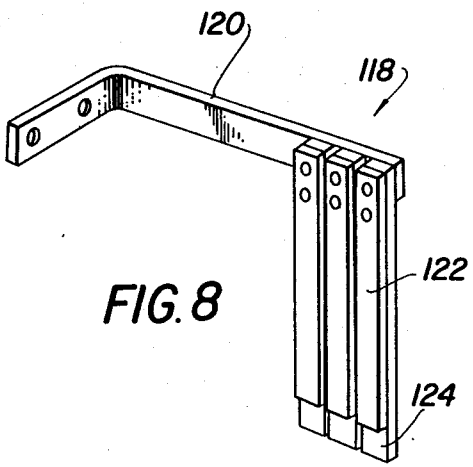
FIG. 8 is an isometric view of the commutation fingers.

The rollers 100 in the tank 18 communicate with the bus bar 104 through contact member 118. The detail of the contact member 118 seen in FIG. 8 shows that the contact members 118 are formed of a bar 120 and a plural array of fingers 122 and 124 that together provide the positive contact over a sufficiently large area on the contact roller 100 to avoid creating a high resistance condition at the point of contact. The fingers 122 and 124 are resiliently mounted on the bar 120 and by the nature of the material, are urged into contact with the contact roller 100 at all times.

Thus, a high strength positive electrical contact assembly is provided for an environment wherein conventional brush contacts cannot serve well.

The high voltage-high current process of the present invention is further facilitated by means for protecting the fibers 2 during the passage between the electrolyte bath and the various contact rollers. The system includes the recirculating spray system 126 shown generally in FIGS. 5 and 6 through which electrolyte is recycled from the plating tanks and sprayed through the spray nozzles 130 on the fibers 2 at contact points on the contact rollers 100.

The spray nozzles 130 are arranged with two parallel tubular arms 136 and 138 having nozzle openings 139 located on the lower surface thereof.

One tubular arm 136 of the spray nozzle 130, is arranged to direct electrolyte tangentially on the fibers 2 at the point at which the fibers 2 leave the contact roller 100. The other tubular arm 138 of the spray nozzle 130 is arranged to deliver electrolyte directly on the top of the contact roller 100 at the point at which the fiber 2 engages the contact roller 100. As previously indicated, it is vital that sufficient tension be applied on the fibers 2 to insure that the fibers 2 are maintained in a tight direct line between the contact rollers 100 and the idler rollers 112. The need for a tight line is to assure that the low contact resistance suitable for current travel is available with high conductivity through the fibers 2 from the contact rollers 100 to the electrolyte bath. The electrolyte which is recirculated over the contact rollers 100 and the fibers 2 provide a parallel resistor in the circuit and serve to cool the fibers 2.

It is known that the fibers 2 being plated have a low fusing current, such as 10 amps for a 12K tow of about 7 microns in diameter However, the process of the present invention requires about 25 amps between contacts or about 125 amps per strand in each tank.

Furthermore, both contact resistance and anisotropic resistance must be overcome. The contract resistance of 12K tow of about 7 microns on pure clean copper is about 2 ohms, thus at 45 volts twenty-two and one-half amps are required before any plating can occur. The anisotrophic resistance is 1,000 times the long axis. Thus, the total contact area must be 1,000 times the tow diameter, which for 7 microns is 0.34 inches. Practice has taught that one-half inch of contact will properly serve the electrical requirement of the system when plating 7 mircon tow, hence two inch contact rollers 100 are used. It is also vital that the contact rollers 100 be located at a specified distance above the electrolyte bath to enable the system to operate at the high voltages necessary to achieve the plating of the process. In practice, it has been found that the contact rollers 100 should be located two inches from the electrolyte bath when voltages of 16 to 25 volts are applied. Further, it has been found that recirculation of about 2 gallons per minute per contact roller traveling at about 1 ½to 25 ft./min. will properly cool the fiber and provide a suitable parallel resistor when above 5,000 amps are passed through the system.

The electrolyte in the process is a solution constituted of eight to ten ounces of metal, preferably in the form of $NiCl_2$ and $NiSO_4$ per gallon of solution. The pH of the solution is set at 4 to 4.5 and the temperature maintained between 145 and 150° F. Recalculation of the electrolyte through the spray nozzles 130 at the desired rate requires that the nozzle openings be 3/32 inches in diameter on 15 "centers over the length of each tubular arm 136 and 138. The presence of electrolyte on the fibers is vital, but care is taken to avoid excessive electrolyte otherwise the contact rollers will become subjected to the plating occurring in the electrolyte.

Figure 14:
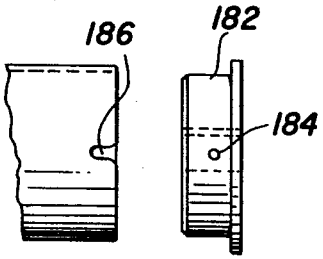
FIG. 14 is a partial detail of the opposite end of the roller of FIG. 12.
Figure 13:
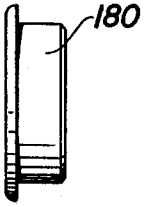
FIG. 13 is a detail of the end cap of the roller of FIG. 12.
Figure 12:
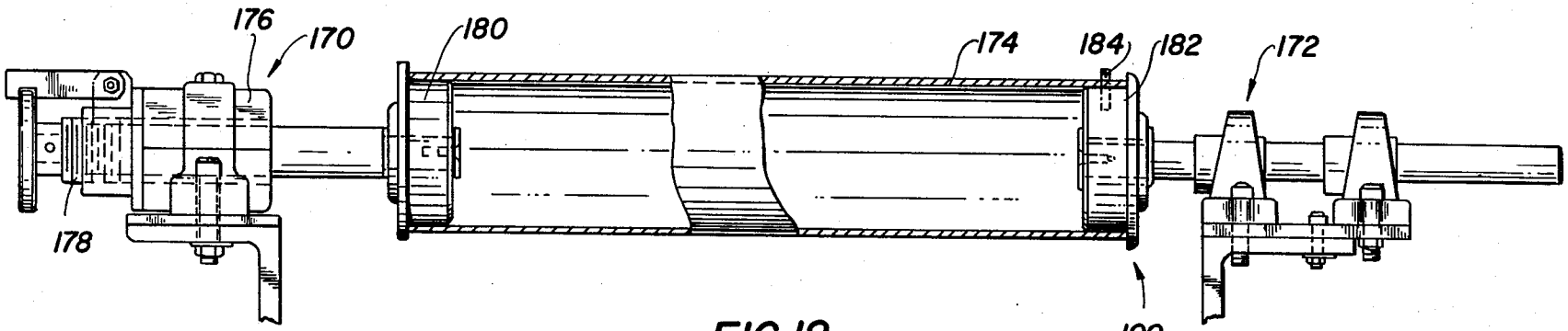
FIG. 12 is a sectional elevational view of a contact roller of the process assembly.

The contact rollers 100 are shown in detail in FIGS. 12–14. Each contact roller 100 is located in close proximity to the electrolyte in the plating tanks and each is adapted to transmit high current through the system in a high intensity voltage environment. The contact roller 100 thus is designed for continual replacement. The contact roller 100 is provided with fixed end mounting sections 170 and 172 which hold a cylindrical copper tube 174. The cylindrical copper tube 174 is arranged to contact the commutator fingers 122-124 and deliver current through both the fibers 2 and recycled electrolyte to the electrolyte bath. The copper tube 174 is formed of conventional type copper which must be able to carry 350 amperes. The diameter of the tubing is critical in that the diameter dictates the contact surface for the fibers 2 and the distance that the contact roller 100 will be from the electrolyte surface. As a result, the mounts 170 and 172 are fixedly arranged in alignment with each other to releasably support the tube 174 of the contact roller 100. The mount 170 is provided with a bearing support 176 through which a screw mount 178 passes. The screw mount 178 rotatably supports the copper tube 174 on a bushing support 180 and has the capacity to release the copper tube 174 upon retraction of the bushing support 180 by withdrawing the screw 178. The mount 172 includes a bushing support 182 on which a detent 184 is formed. Each copper tube 174 is provided with a notched mating slot 186 to fit around the detent 184 and effect positive attachment of the copper tube 174 to the bushing support 182 thereby obviating any uncertainty in alignment and facilitating dispatch in replacing each copper tube section 174. The overall electrical system 188 of the process and apparatus is shown schematically in FIG. 15 wherein the capacity for discrete application of voltage and current to each electrolytic tank 18, 20, 22, 24 can be seen. Conventional rectify 189, 191, 193 and 195 are arranged as a D.C. power source to deliver current to the respective contact rollers 100 on each electrolytic tank. Bus bars 104, 194, 196, 198 are shown for illustration extending respectively from the rectifiers 189, 191, 193 and 195 to one of the six contact rollers 100 on the electrolytic tank 18, 20, 22 and 24. However, all six contact rollers 100 on each electrolytic tank are directly connected to the same bus bar. Bus bars 106, 202, 204 and 206 are shown extending respectively from the same rectifiers 189, 191, 193 and 195 through cables 208 to one anode support bar 102 mounted on the electrolytic tanks 18, 20, 22 and 24. Again the respective anode bus bars contact each anode support bar 102 mounted on each electrolytic tank connected to the bus bar.

As a result of the arrangement, discrete high voltage can be delivered to each electrolytic tank 18, 20, 22, 24 as a function of the metal panting on the fibers 2 in each electrolytic tank.

Practice has taught that the voltage in the first electrolyte tank 18 should not be below 16 volts and seldom be below 24 volts. The voltage in the second tank 20 should not be below 14 volts and the voltage in the third electrolight tank 22 should not be below 12 volts.

Illustratively, fibers 2 have been coated in a system of three rectifier-electrolyte tank assemblies, rather than the four shown in FIGS. 1 and 15 under the following conditions wherein excellent coating has resulted:

| | | | |
|---|---|---|---|
| RECTIFIER | 189 | 191 | 193 |
| AMPS | 1,400 | 1,400 | 1,400 |
| VOLTS | 45 | 26 | 17 |

The nickel metal coated fibers 2 produced under these conditions have the following properties and characteristics:

Filament Shape Round (but dependent on graphite fiber)

Diameter 8 microns Metal Coating Approximately 0.5 microns thick, about 50% of the total fiber weight.

Density 2.50–3.00 grams/cm.$^3$ *Tensile Strength Up to* 450,000 psi Tensile Modulus 34 M psi Electrical 0.008 ohms/cm. (12K tow) Conductivity 0.10 ohms/1000 pl strands/cm.

After the nickel plating has occurred, the fully plated fibers 2 are delivered to the rinsing section 12 seen in FIG. 1.

The drag-out section 42 and rinse section 46 are arranged with tanks to accumulate the discharge from the tees 44, 44A, 44B, 48 and 48A and both neutralize the discharge for waste disposal and provide a repository for accumulation of make-up for the electrolyte tanks 18, 20, 22 and 24.

Figure 16:
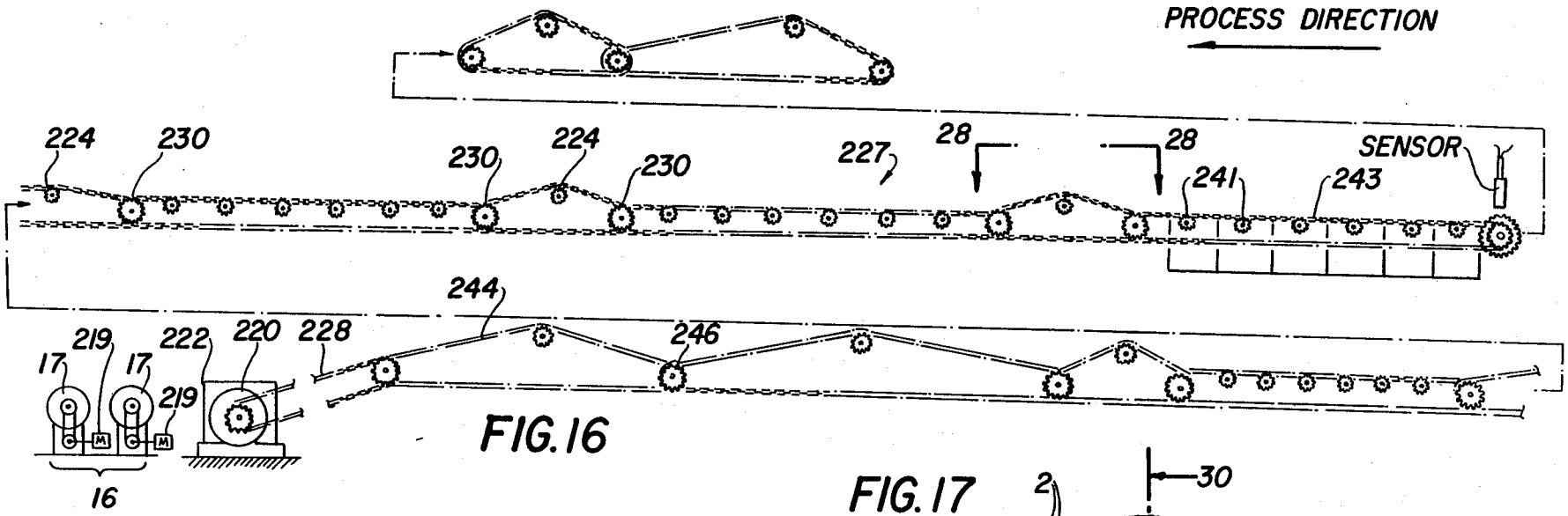
FIG. 16 is a drawing of the mechanism for synchronously driving the apparatus of the subject invention.
Figure 17:
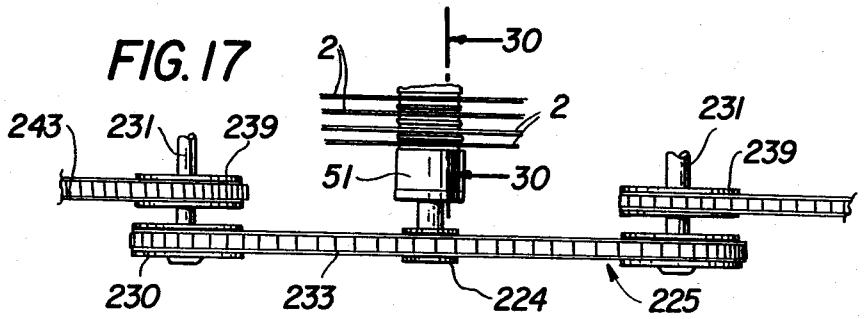
FIG. 17 is a plan view through line 28-13 28 of the section of FIG. 16.
Figure 18:
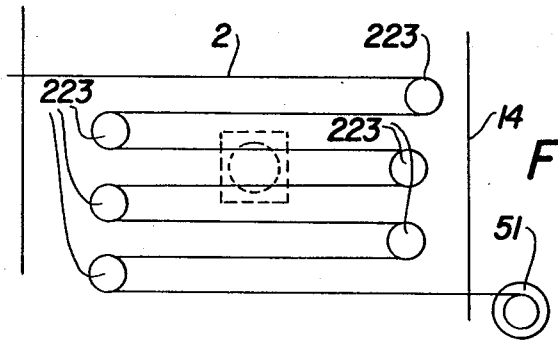
FIG. 18 is a side elevational view of the roller assembly in the drying section of the system.

The apparatus of the present invention is arranged for synchronous operation as shown in FIGURES 16–18. A motor 222 is provided to insure that the contact rollers 100 and the guide rollers 51 rotate at the same speed to avoid abrading the fibers 2.

The motor 222 directly drives an assembly of rollers 223 arranged to effect a capstan. The rollers 223 are located in the dryer 14 and as best seen in FIG. 17 cause the fiber to reverse direction six times. The reversal in direction is sufficient to impose a force on the fibers 2 that will pull the fibers through the apparatus without allowing slack.

In addition, the motor 222 is connected by a gear and chain assembly to drive each contact roller 100 and each guide roller 51 at the same speed.

In essence, the gear and chain assembly is comprised of guide drive assemblies 225, best seen in FIG. 17 and contact roller drive assemblies 227. Each guide drive assembly 225 includes drive transmission gear 230 mounted on shafts 231, a gear 224 fixedly secured to the guide roller 51 and a chain 233 that engages the gears 230 and 224.

The contact roller drive assembly includes drive transmission gear 239 mounted on the shafts 231 common to the gears 230, a gear 241 fixedly secured to each contact roller 100 and a chain 243 that engages both gears 239 and each of the gears 241 on the six contact rollers 100 associated with each electrolyte tank.

The location of the capstan rollers 223, seen in FIG. 18, in the dryer 14 enhances drying. The flat surface and force applied to the fibers 2 spreads the fibers and thereby accelerates drying.

The system also includes a variable speed clutch override drive motor 219 for the take-up reels 17. The force generated by the variable torque motor 219 provides the force to draw the fiber 2 through the system. However, the capstan rollers 223 provide a means to isolate the direct force imposed on the fibers 2 at the take-up reels 17 from the fibers 2 upstream of the capstan rollers.

What is claimed is:

1. A process for continuously processing non-metallic or semi-metallic fiber in an electrolyte wherein electrical current is delivered to the electrolyte through the fiber comprising the steps of:

drawing the fiber through the process; passing the fiber through the electrolyte; imposing a tension on the fiber at a location upstream of the location at which the fiber enters the electrolyte by passage of the fiber over an array of rollers driven selectively at some speed less than the speed of the fiber.

2. A process for continuously processing a non-metallic or semi-metallic fiber in an apparatus containing an electrolyte wherein electrical current is delivered to the electrolyte through the fiber comprising the steps of:

drawing the fiber through the apparatus;

passing the fiber through the electrolyte; and imposing a tension on the fiber at a location upstream of the location at which the fiber enters the electrolyte by passage of the fiber over an array of rollers driven selectively at a speed less than the speed of the fiber such that the tension is sufficient to prevent said delivered current from overloading and causing destruction of the fibers without abrading the fibers or causing fuzz to develop thereon.

* * * * *